US009803147B2

(12) United States Patent
Bhattacharya et al.

(10) Patent No.: US 9,803,147 B2
(45) Date of Patent: Oct. 31, 2017

(54) METHOD FOR MAKING MIDDLE DISTILLATES AND A HEAVY VACUUM GAS OIL FCC FEEDSTOCK

(71) Applicants: Subhasis Bhattacharya, Walnut Creek, CA (US); Ujjal Kumar Mukherjee, Montclair, NJ (US); Marvin I. Greene, Hackensack, NJ (US)

(72) Inventors: Subhasis Bhattacharya, Walnut Creek, CA (US); Ujjal Kumar Mukherjee, Montclair, NJ (US); Marvin I. Greene, Hackensack, NJ (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 14/541,874

(22) Filed: Nov. 14, 2014

(65) Prior Publication Data

US 2015/0136645 A1 May 21, 2015

Related U.S. Application Data

(60) Provisional application No. 61/906,055, filed on Nov. 19, 2013.

(51) Int. Cl.

| | |
|---|---|
| ***C10G 65/12*** | (2006.01) |
| ***C10G 65/10*** | (2006.01) |
| ***C10G 69/00*** | (2006.01) |

(52) U.S. Cl.
CPC ..... *C10G 65/12* (2013.01); *C10G 65/10* (2013.01); *C10G 69/00* (2013.01)

(58) Field of Classification Search
CPC .... C10G 2300/1003; C10G 2300/1011; C10G 2300/1053; C10G 2300/107; C10G 2300/1074; C10G 2300/1077; C10G 2400/02; C10G 2400/04; C10G 2400/08; C10G 65/12; C10G 69/00; C10G 65/10; C10G 2400/16; C10G 2400/06
See application file for complete search history.

(56) References Cited

U.S. PATENT DOCUMENTS

| | | | | |
|---|---|---|---|---|
| 2008/0011644 | A1* | 1/2008 | Dean | C10G 11/18 208/113 |
| 2009/0050524 | A1* | 2/2009 | Kim | C10G 65/12 208/89 |
| 2014/0221712 | A1* | 8/2014 | Greene | C10G 65/12 585/302 |

* cited by examiner

*Primary Examiner* — Randy Boyer
*Assistant Examiner* — Juan Valencia
(74) *Attorney, Agent, or Firm* — Mark L. Warzel

(57) ABSTRACT

The present invention is directed to a refining process for producing hydroprocessed distillates and a heavy vacuum gas oil (HVGO). The process produces middle distillates that have reduced nitrogen and sulfur content, while simultaneously producing a 900° F.$^+$ (482° C.$^+$) HVGO stream useful as a fluidized catalytic cracking (FCC) unit feedstock.

13 Claims, 2 Drawing Sheets

METHOD FOR MAKING MIDDLE DISTILLATES AND A HEAVY VACUUM GAS OIL FCC FEEDSTOCK

CROSS-REFERENCE TO RELATED APPLICATIONS

The present application for patent claims the benefit of U.S. provisional patent application bearing Ser. No. 61/906,055, filed on Nov. 19, 2013, which is incorporated by reference in its entirety.

FIELD OF THE INVENTION

The present invention is directed to a refining process for producing hydroprocessed distillates and a heavy vacuum gas oil (HVGO). The process produces middle distillates that have reduced nitrogen and sulfur content, while simultaneously producing a 900F$^+$ (482° C.$^+$) HVGO stream useful as a fluidized catalytic cracking (FCC) unit feedstock.

BACKGROUND OF THE INVENTION

Catalytic hydroprocessing refers to petroleum refining processes in which a carbonaceous feedstock is brought into contact with hydrogen and a catalyst, at a higher temperature and pressure, for the purpose of removing undesirable impurities and/or converting the feedstock to an improved or more valuable product.

Heavy hydrocarbon feedstocks can be liquid, semi-solid and/or solid at atmospheric conditions. Such heavy hydrocarbonaceous feedstocks can have an initial ASTM D86-12 boiling point of 600° F. (315° C.) or greater.

The feedstock properties that influence its hydroprocessability include: organic nitrogen content, especially basic nitrogen content; feed boiling range and end point; polycyclic aromatics content and previous processing history (i.e., straight run versus thermally cracked).

Heavy hydrocarbonaceous oils boiling in the gas oil range can be high in heteroatom content, especially nitrogen. Nitrogen content can range from about 50 ppmw to greater than 5,000 ppmw elemental nitrogen, based on total weight of the heavy hydrocarbonaceous oils. The nitrogen containing compounds can be present as basic or non-basic nitrogen species. Examples of basic nitrogen species include pyridines, alkyl substituted pyridines, quinolines, alkyl substituted quinolines, acridines, alkyl substituted acridines, phenyl and naphtha substituted acridines. Examples of non-basic nitrogen species include pyrroles, alkyl substituted pyrroles, indoles, alkyl substituted indoles, carbazoles and alkyl substituted carbazoles.

Heavy hydrocarbonaceous oils boiling in the gas oil range can have sulfur contents ranging from about 500 ppmw to about 100,000 ppmw elemental sulfur (based on total weight of the heavy hydrocarbonaceous oils). The sulfur will usually be present as organically bound sulfur. Examples of such sulfur compounds include the class of heterocyclic sulfur compounds including, but not limited to, thiophenes, tetrahydrothiophenes, benzothiophenes and their higher homologues and analogues. Other organically bound sulfur compounds include aliphatic, naphthenic and aromatic mercaptans, sulfides, disulfides and polysulfides.

Gas oil range feeds contain polycyclic condensed hydrocarbons having two or more fused rings. The rings can either be saturated or unsaturated (aromatic). For the latter, these polycyclic condensed hydrocarbons are also called polynuclear aromatics (PNA) or polyaromatic hydrocarbons (PAH). The light PNAs, with two to six rings, are present in virgin vacuum gas oil streams. The heavy PNAs (HPNA) generally contain 7-10 rings, but can contain higher amounts including 11 rings or at least 14 rings or dicoronylene (15-rings) or coronylenovalene (17-rings) or higher.

Hydrocracking is an important refining process used to manufacture middle distillate products boiling in the 250-700° F. (121-371° C.) range, such as, kerosene, and diesel. Hydrocracking feedstocks contain significant amounts of organic sulfur and nitrogen. The sulfur and nitrogen must be removed to meet fuel specifications.

Removal or reduction of the sulfur and nitrogen is also critical to the operation of a hydrocracking reactor. For certain low quality feedstocks, the nitrogen content and corresponding basic nitrogen content are most critical in being able to achieve high hydrocracking conversion rates. This is because of the strong poisoning effect that basic nitrogen compounds have on the acid sites of hydrocracking catalysts. Thus, higher basic nitrogen content will cause the need to increase the catalyst bed temperatures over time due to a decrease in catalytic activity caused by deactivation by poisoning, which shortens the cycle life of the catalyst.

Catalyst poisoning is primarily the result of strong chemisorption of impurities on active sites. Poisoning may be reversible or irreversible, depending on the strength of chemisorption of the impurity on the catalyst. Catalyst poisoning may also be selective or non-selective. Selective poisoning is commonly observed on multi-functional catalysts having different types of active sites, such as for example, hydrocracking catalysts which exhibit both cracking and hydrogenation-dehydrogenation functions. In such a case, selective poisoning may lead to the poisoning of one type of active site without affecting the other type or types.

Another mechanism of poisoning of hydroprocessing catalysts is coke or coke precursor deposition on the active catalyst sites. Light PNAs can serve as precursors in the formation of the larger PNAs. Most of the HPNAs having more than 6 fused rings are formed during the processing of heavy gas oil components under severe hydrocracking conditions, e.g., high total conversions under recycle conditions. These heavy PNAs have a deleterious effect on the performance of the hydrocracking catalysts and the hydrocracking reaction system equipment as a result of carbon deposition on the catalysts as well as in the reaction loop.

FIG. 1 is a flow scheme for a typical two-stage, high conversion hydrocracking unit. This particular flow scheme is typically used for hydroprocessing disadvantaged hydrocracker feedstocks, such as heavy vacuum gas oils and heavy coker gas oils. These feedstocks have high amounts of nitrogen, often between 500 and 2000 ppm and sulfur, often between 0.5 and 3.5 wt %, and a low API, typically between 15 and 20.

In the two-stage hydrocracking scheme illustrated in FIG. 1, a desalted crude oil feedstock 1 is distilled in an atmospheric crude distillation unit 2. The bottoms or residuum 3 from the atmospheric distillation process is then distilled in a vacuum distillation unit 4. Typical vacuum distillation units are operated to deliver a HVGO/residue cut-point of approximately 1,050° F. (566° C.). Higher cut-points (also referred to as deeper cuts) would be beneficial as this would yield a higher volume of HVGO for processing into valuable middle distillate product. However, running the vacuum distillation unit 4 at a higher cut-point means a more disadvantaged feedstock (higher particulates, more sulfur and nitrogen species and heavy polyaromatic hydrocarbons), requiring the downstream hydroprocessing units to run at higher severity levels (higher feed residence time or lower "liquid hour space velocity," and higher temperatures), lessening the life of the catalysts.

A HVGO cut 5 from the vacuum distillation unit 4 is hydrotreated in a conventional hydrotreating reactor 6, to saturate complex naphthenic and aromatic compounds and reduce feed contaminants such as nitrogen and sulfur which, if left untreated, would otherwise poison downstream hydrocracking catalysts.

The hydrotreated HVGO 7 is then subjected to hydrocracking conditions in a first stage hydrocracker unit 8, followed by atmospheric distillation of the hydrocracked HVGO feedstock 9 in an atmospheric fractionation column 10. In a typical two-stage hydroprocessing unit, the first stage hydrocracker unit 8 is operated at a severity sufficient to achieve a 45-50% conversion.

Light ends 11 and middle distillate products such as naphtha 12, kerosene 13 and diesel 14 are recovered from the atmospheric fractionation column 10, and the atmospheric bottoms fraction 15 is subjected to further hydrocracking conditions in a second stage hydrocracker unit 16. An FCC bleed 17 from the atmospheric bottoms fraction 15 stream is passed to a standard fluidized catalytic cracking (FCC) unit 18. FCC units convert high-boiling, high-molecular weight hydrocarbon fractions of petroleum crude oils into more valuable gasoline 19, olefinic gases used for making alkylate, and other products such as naphtha. Catalysts employed in FCC units are substantially more tolerant of feedstocks containing high amounts of nitrogen, sulfur and PNAs, as compared to conventional hydrocracking catalysts.

The entire second stage hydrocracker effluent 20 is recycled back to the atmospheric fractionation column 10. This configuration requires the undesirable components (N, S, PNAs) in the atmospheric bottoms fraction 15 to be recycled to extinction within the hydrocracking loop.

However, the configuration illustrated in FIG. 1 has some disadvantages. The feed considerations for the second stage hydrocracker unit 16 take priority over the feed considerations for the FCC unit 18. Because the entire bottoms 15 from the atmospheric fractionation column 10 are passed to the second stage hydrocracker unit 16, the first stage hydrocracker unit 8 must operate at a high level of severity to ensure the feed to the second stage hydrocracker unit 16 has been converted and hydrotreated to a level high enough for the second stage hydrocracker unit 16 to accommodate the feed (e.g. to prolong the life of the catalyst in the second stage). In contrast, FCC units can accommodate heavy feeds high in nitrogen, sulfur and aromatics. This means the FCC bleed 17 in this configuration has been hydroprocessed to a greater degree than is necessary for the FCC unit to meet the FCC unit product specifications.

| | Typical Feed to $2^{nd}$ Stage | Typical Feed to FCC |
|---|---|---|
| API Gravity | 28-33 | 21-25 |
| Sulfur, ppm | <50 | <2000 |
| Nitrogen, ppm | 1-5 | 50-200 |
| TBP 95% Point, ° F. (° C.) | 950-1050 (510-566) | 1050-1350 (566-732) |

Further, this configuration is operated essentially as a full conversion zone. This means the bottom or residuum fractions are all converted in the hydrocracking units. This requires more catalyst which, in turn, requires larger reactors to be built and placed into service, adding substantial cost to the construction and operation of the hydrocracking train, both $1^{st}$ and $2^{nd}$ stage. In addition, more hydrogen is required to operate these larger hydrocracking units, in view of the higher severity operations, adding to the operating costs for the refiner.

Finally, because this configuration is operated as a full conversion zone, the $1^{st}$ stage hydrocracking unit must be operated at high severity in order to reduce the nitrogen, sulfur and PNA to concentrations low enough for the $2^{nd}$ stage to hydroprocess without deactivation. This results in shorter catalyst lifetimes and unit fouling.

Accordingly, there is a current need for a two-stage hydrocracking process capable of producing middle distillates that have reduced nitrogen, sulfur content, while simultaneously producing a 900° F.$^+$ (482° C.$^+$) HVGO stream useful as a feedstock to fluidized catalytic cracking unit.

There is also a current need for a two-stage hydrocracking process which utilizes less hydrogen than a conventional two-stage hydrocracking process, and which can be operated under less severe conditions than a standard two-stage hydrocracking process, thereby reducing the amount of hydrocracking catalyst and hydrogen needed to achieve the target product specifications.

SUMMARY OF THE INVENTION

The present invention is directed to a refining process for producing hydroprocessed distillates and a heavy vacuum gas oil (HVGO). The process produces middle distillates that have reduced nitrogen and sulfur content, while simultaneously producing a 900 F$^+$ . (482° C.$^+$) HVGO stream useful as a fluidized catalytic cracking (FCC) unit feedstock.

DETAILED DESCRIPTION OF THE INVENTION

Introduction

Figure 1:
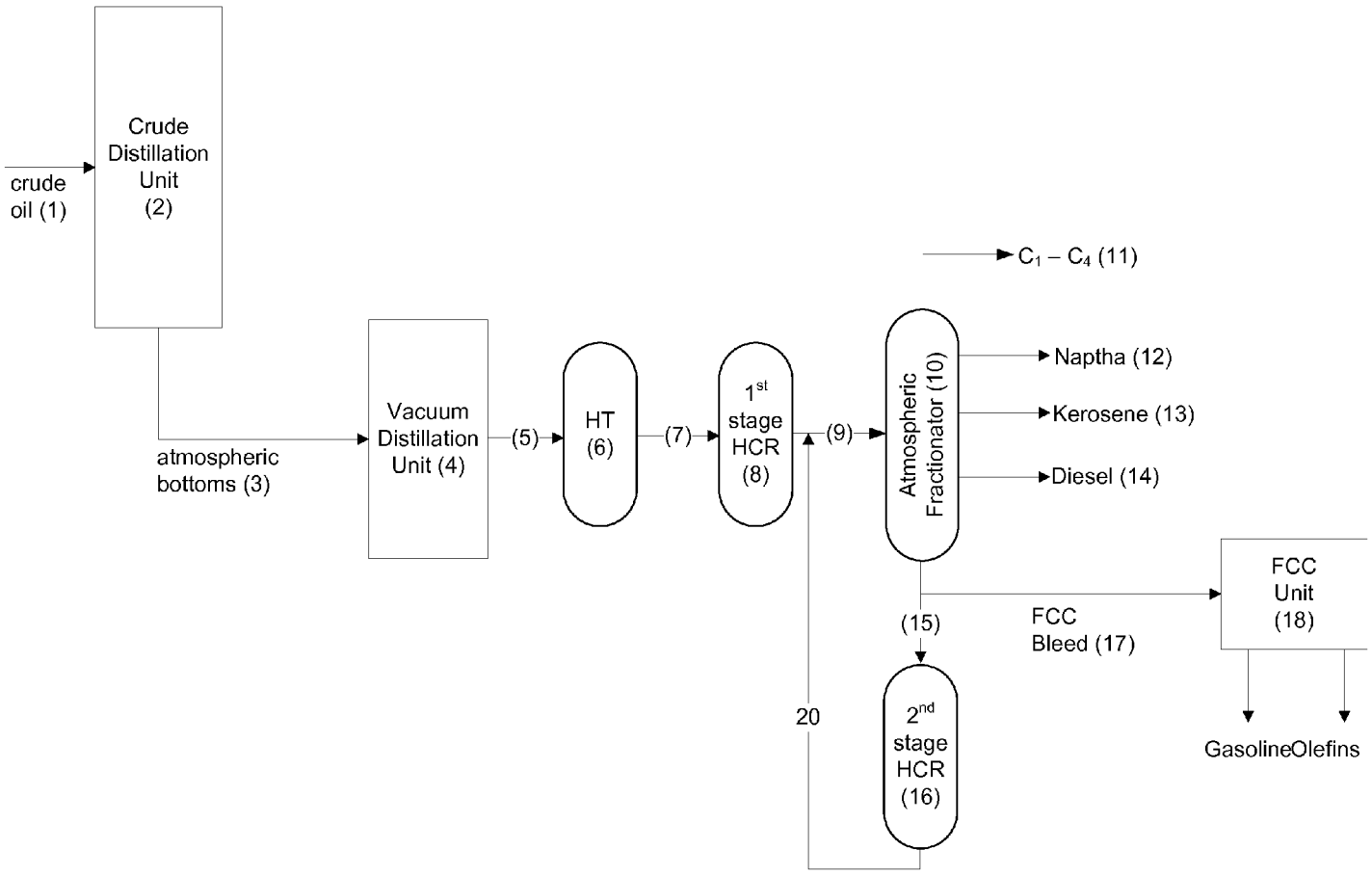
(PRIOR ART) FIG. 1
FIG. 1 is a block flow diagram of a conventional two-stage hydrocracking process.

"Periodic Table" refers to the version of IUPAC Periodic Table of the Elements dated Jun. 22, 2007, and the numbering scheme for the Periodic Table Groups is as described in Chemical and Engineering News, 63(5), 27 (1985).

"Hydroprocessing" refers to a process in which a carbonaceous feedstock is brought into contact with hydrogen and a catalyst, at a higher temperature and pressure, for the purpose of removing undesirable impurities and/or converting the feedstock to a desired product.

"Hydrotreating" refers to a process that converts sulfur- and/or nitrogen-containing hydrocarbon feeds into hydrocarbon products with reduced sulfur and/or nitrogen content, typically in conjunction with a hydrocracking function, and which generates hydrogen sulfide and/or ammonia (respectively) as byproducts.

"Hydrocracking" refers to a process in which hydrogenation and dehydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins "Hydroisomerization" refers to a process in which normal paraffins are isomerized to their more branched counterparts in the presence of hydrogen and over a catalyst.

"Hydrodemetalization" refers to a process that removes undesirable metals from hydrocarbon feeds and converts the latter into hydrocarbon products with reduced metal content.

"Column" refers to a distillation or fractionation column or columns for separating a feedstock into one or more fractions having differing cut points.

"Cut point" refers to the temperature on a True Boiling Point ("TBP") curve (i.e., a batch process curve of percent of feed removed in a heavily refluxed tower versus temperature reached to achieve that removal) at which a predetermined degree of separation is reached.

"True Boiling Point" (TBP) refers to the boiling point of a feed which as determined by ASTM D2887-13.

"Bottoms fraction" means the heavier fraction, separated by fractionation from a feedstock, as a non-vaporized (i.e. residuum) fraction.

"Hydrocracked heavy fraction" means the heavy fraction after having undergone hydrocracking.

"Hydrocarbonaceous" means a compound or substance that contains hydrogen and carbon atoms, but which can include heteroatoms such as oxygen, sulfur or nitrogen.

"Middle distillates" include jet fuel, diesel fuel, naphtha and kerosene.

| Distillates | Typical Cut Points, ° F. (° C.) |
|---|---|
| Light Naphtha | $C_5$-180 ($C_5$-82) |
| Heavy Naphtha | 180-270 (82-132) |
| Kerosene | 270-550 (132-288) |
| Diesel | 550-700 (288-371) |

Where permitted, all publications, patents and patent applications cited in this application are herein incorporated by reference in their entirety; to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "include" and its variants are intended to be non-limiting, such that recitation of items in a list is not to the exclusion of other like items that may also be useful in the materials, compositions and methods of this invention.

Properties for materials described herein are determined as follows:

(a) Constrained index (CI): indicates the total cracking conversion of a 50/50 mixture of n-hexane and 3-methylpentane by a sample catalyst at 900° F. (482° C.), 0.68 WHSV. Samples are prepared according to the method described in U.S. Pat. No. 7,063,828 to Zones and Burton, issued Jun. 20, 2006.

(b) Brønsted acidity: determined by isopropylamine-temperature-programmed desorption (IPam TPD) adapted from the published descriptions by T. J. Gricus Kofke, R. K. Gorte, W. E. Farneth, J. Catal. 114, 34-45, 1988; T. J. Gricus Kifke, R. J. Gorte, G. T. Kokotailo, J. Catal. 115, 265-272, 1989; J. G. Tittensor, R. J. Gorte and D. M. Chapman, J. Catal. 138, 714-720, 1992.

(c) $SiO_2/Al_2O_3$ Ratio (SAR): determined by ICP elemental analysis. A SAR of infinity (∞) represents the case where there is no aluminum in the zeolite, i.e., the mole ratio of silica to alumina is infinity. In that case the molecular sieve is comprised of essentially all of silica.

(d) Surface area: determined by $N_2$ adsorption at its boiling temperature. BET surface area is calculated by the 5-point method at $P/P_0$=0.050, 0.088, 0.125, 0.163, and 0.200. Samples are first pre-treated at 400° C. for 6 hours in the presence of flowing, dry $N_2$ so as to eliminate any adsorbed volatiles like water or organics.

(e) Micropore volume: determined by $N_2$ adsorption at its boiling temperature. Micropore volume is calculated by the t-plot method at $P/P_0$=0.050, 0.088, 0.125, 0.163, and 0.200. Samples are first pre-treated at 400° C. for 6 hours in the presence of flowing, dry $N_2$ so as to eliminate any adsorbed volatiles like water or organics.

(f) Mesopore pore diameter: determined by $N_2$ adsorption at its boiling temperature. Mesopore pore diameter is calculated from $N_2$ isotherms by the BJH method described in E. P. Barrett, L. G. Joyner and P. P. Halenda, "The determination of pore volume and area distributions in porous substances. I. Computations from nitrogen isotherms." J. Am. Chem. Soc. 73, 373-380, 1951. Samples are first pre-treated at 400° C. for 6 hours in the presence of flowing, dry $N_2$ so as to eliminate any adsorbed volatiles like water or organics.

(g) Total pore volume: determined by $N_2$ adsorption at its boiling temperature at $P/P_0$=0.990. Samples are first pre-treated at 400° C. for 6 hours in the presence of flowing, dry $N_2$ so as to eliminate any adsorbed volatiles like water or organics.

(h) Unit cell size: determined by X-ray powder diffraction.

(i) Alpha value: determined by an Alpha test adapted from the published descriptions of the Mobil Alpha test (P. B. Weisz and J. N. Miale, J. Catal., 4, 527-529, 1965; J. N. Miale, N. Y. Chen, and P. B. Weisz, J. Catal., 6, 278-87, 1966). The "Alpha Value" is calculated as the cracking rate of the sample in question divided by the cracking rate of a standard silica alumina sample. The resulting "Alpha" is a measure of acid cracking activity which generally correlates with number of acid sites.

(j) Polycyclic Index (PCI): as measured by ASTM D6397-11.

Process Overview and Conditions

Figure 2:
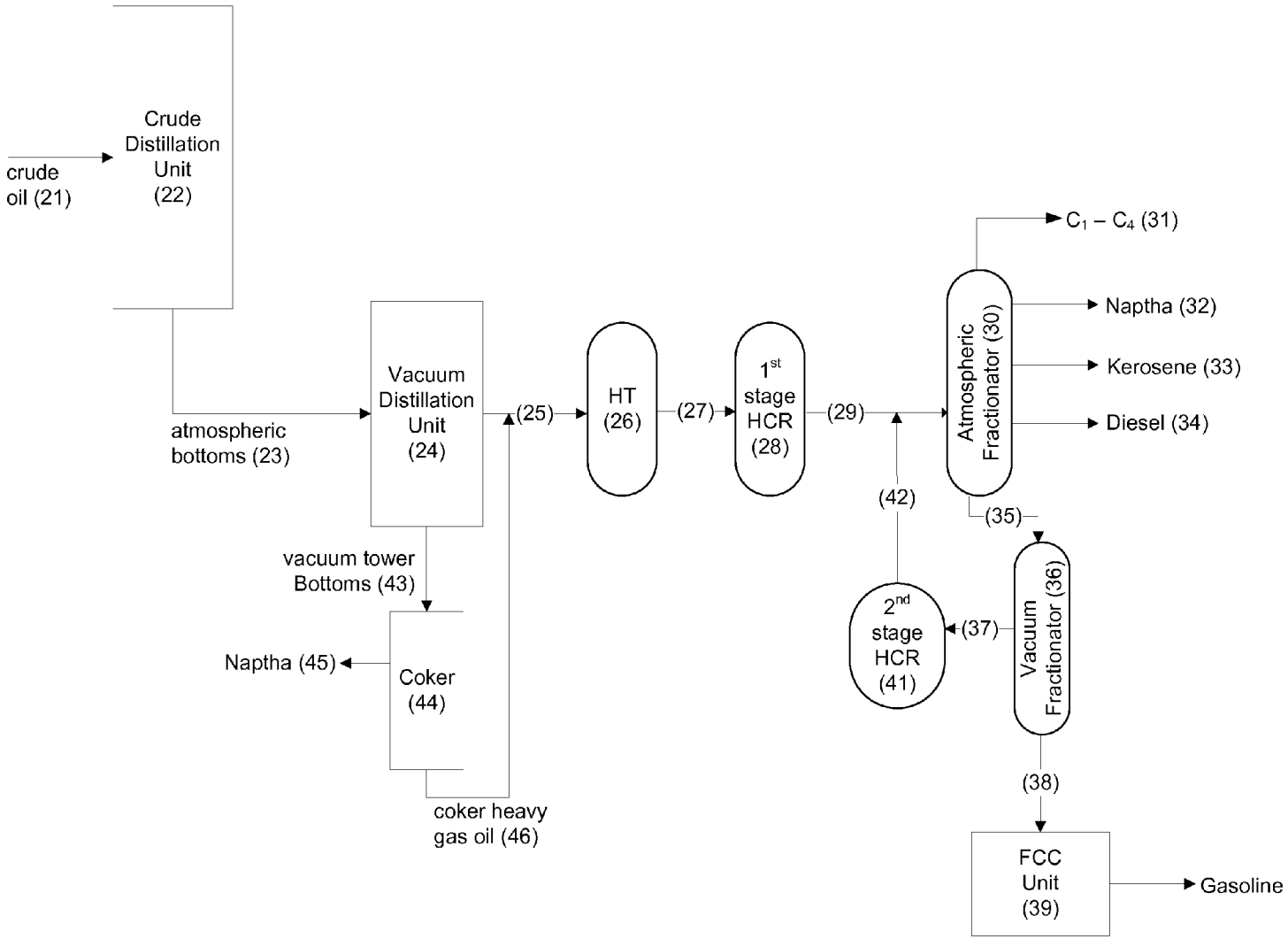
FIG. 2 is a block flow diagram of a refining process for making middle distillates and a heavy vacuum gas oil FCC feedstock, as described herein.

FIG. 2 is a flow scheme for an improved refining process for making middle distillates and a heavy vacuum gas oil (HVGO) FCC feedstock. This particular flow scheme is particularly suited for hydroprocessing highly disadvantaged hydrocracker feedstocks that ordinarily could not be refined using a conventional two-stage hydrocracking process. These feedstocks have high amounts of nitrogen (often greater than 4000 ppm) and sulfur (often greater than 3.5 wt. %), and a low API Gravity, typically below 15.

The refining equipment used in the refining process described below will consist of conventional process equipment typically used in commercial hydrocracking units for recovery of product and unconverted feedstock, including caustic scrubbers, flash drums, suction traps, acid washes, fractionators and separators, and the like.

Each hydrotreating and hydrocracking stage can be accomplished using one or more fixed beds or reaction zones within a single reactor, each of which can include one or more catalyst layers of the same, or different, hydroprocessing catalyst. Although other types of catalyst beds can be used, fixed beds are preferred. Such other types of catalyst beds suitable for use herein include fluidized beds, ebullating beds, slurry beds, and moving beds.

Interstage cooling or heating between reactors nes, or between catalyst beds in the same reactor, can be employed since the hydroprocessing reaction is generally exothermic. A portion of the heat generated during hydroprocessing can be recovered. Where this heat recovery option is not available, conventional cooling may be performed through cooling utilities such as cooling water or air, or through use of a hydrogen quench stream. In this manner, optimum reaction temperatures can be more easily maintained.

In the refining scheme illustrated in FIG. 2, a desalted crude oil feedstock 21 is distilled in an atmospheric crude distillation unit 22. The bottoms or residuum 23 from the atmospheric distillation process is then distilled in a vacuum distillation unit 24. The vacuum distillation unit 24 is operated to deliver a HVGO/residue cut-point of approximately 1050° F. (566° C.) to 1350° F. (732° C.). The process of the present invention permits the refiner to select higher cut-points (also referred to as deeper cuts), therefore yielding a higher volume of HVGO for processing into valuable middle distillate product, without requiring the downstream hydroprocessing units to run at higher severity levels (higher feed residence time or lower "liquid hour space velocity," and higher temperatures).

A HVGO feedstock 25 from the vacuum distillation unit 24 is preferably hydrotreated in a conventional hydrotreating reactor 26, to saturate complex naphthenic and aromatic compounds and reduce feed contaminates such as nitrogen and sulfur.

| | Conventional HT | HT in the Process of Present Invention |
|---|---|---|
| Typical conversion, % | 40-45 | 25-30 |
| LHSV, 1/hr | 0.4-0.5 | 0.6-0.8 |

Table 1 below lists the typical physical properties for the HVGO feedstock 25, and Table 2 illustrates the hydrotreating process conditions.

TABLE 1

| | HVGO Feedstock |
|---|---|
| Properties | |
| Gravity, °API | 13.5-17.0 |
| N, ppm | 4,000-7,000 |
| S, wt % | 2.5-4.5 |
| Polycyclic index (PCI) | 7,000-11,000 |
| Distillation Temperature (wt %), ° F. (° C.) | |
| 5 | 790 (421) |
| 10 | 845 (452) |
| 30 | 960 (514) |
| 50 | 1035 (557) |
| 70 | 1115 (602) |
| 90 | 1230 (666) |
| 95 | 1290 (699) |
| Entire product | 1355 (735) |

TABLE 2

| Hydrotreating Conditions | |
|---|---|
| Liquid hour space velocity (LHSV) | 0.6-0.8 $hr^{-1}$ |
| $H_2$ partial pressure | 500-2000 psig |
| $H_2$ consumption rate | 1000-5000 SCF/Bbl |
| Operating temperature | 700-800° F. (371-427° C.) |
| Conversion (%) | 25-30 |

Though the process described herein is described as using a HVGO hydrocarbonaceous feedstock, other highly disadvantaged hydrocarbonaceous feedstocks having properties similar to a HVGO feedstock, particularly those that are normally not conducive to middle distillate production using a conventional two-stage hydrocracking process, can be used instead of or with the HVGO, such as visbroken gas oils, heavy coker gas oils, gas oils derived from residue hydrocracking or residue desulfurization, other thermally or catalytically cracked oils, de-asphalted oils, cycle oils from an FCC unit, heavy coal-derived distillates, coal gasification byproduct tars, and heavy shale-derived oils, organic waste oils such as those from pulp/paper mills or waste biomass pyrolysis units.

Referring again to FIG. 2, the hydrotreated HVGO 27 is then subjected to hydrocracking conditions in a first stage hydrocracker unit 28, followed by atmospheric distillation of the hydrocracked first stage HVGO effluent 29 in an atmospheric fractionation column 30.

Table 3 below lists the typical physical properties for the hydrocracked HVGO feedstock 29, and Table 4 illustrates the hydrotreating process conditions.

TABLE 3

| | Hydrocracked HVGO Feedstock |
|---|---|
| Properties | |
| Gravity, °API | 27-32 |
| N, ppm | 10-50 |
| S, ppm | 100-500 |
| Distillation Temperature (wt %), ° F. (° C.) | |
| 5 | 300 (149) |
| 10 | 390 (199) |
| 30 | 675 (357) |
| 50 | 860 (460) |
| 70 | 990 (532) |
| 90 | 1110 (599) |
| 95 | 1170 (632) |
| Entire product | 1346 (730) |

TABLE 4

| 1st Stage Hydrocracking Conditions | |
|---|---|
| Liquid hour space velocity (LHSV) | 0.6-0.8 $hr^{-1}$ |
| $H_2$ partial pressure | 500-2000 psig |
| $H_2$ consumption rate | 1000-5000 SCF/Bbl |
| Operating temperature | 700-800° F. (371-427° C.) |
| Conversion (%) | 25-30 |

Light ends 31 and one or more middle distillate products such as naphtha 32, kerosene 33 and diesel 34 are recovered from the atmospheric fractionation column 30, and the atmospheric bottoms fraction 35 is subjected to further fractionation in a hydrocracker vacuum fractionation column 36 to yield a side-cut VGO fraction 37 and a HVGO FCC feedstock 38. The hydrocracker vacuum distillation column 36 is operated to deliver a side-cut VGO cut-point of approximately 900° F. (482° C.) to 1,000° F. (538° C.). Tables 5 and 6 below lists the typical physical properties for the side-cut VGO fraction 37 and HVGO FCC feedstock 38, respectively.

TABLE 5

| | Side-cut VGO fraction |
|---|---|
| Properties | |
| Gravity, °API | 30-34 |
| N, ppm | 1-3 |
| S, ppm | 10-100 |

TABLE 5-continued

| | Side-cut VGO fraction |
|---|---|
| Distillation Temperature (wt %), ° F. (° C.) | |
| 5 | 750 (399) |
| 10 | 780 (416) |
| 30 | 840 (449) |
| 50 | 890 (477) |
| 70 | 930 (499) |
| 90 | 970 (521) |
| 95 | 980 (527) |
| Entire product | 1000 (538) |

TABLE 6

| | HVGO FCC Feedstock |
|---|---|
| Properties | |
| Gravity, °API | 25-29 |
| N, ppm | 10-150 |
| S, ppm | 100-1000 |
| Distillation Temperature (wt %), ° F. (° C.) | |
| 5 | 990 (532) |
| 10 | 1000 (538) |
| 30 | 1047 (564) |
| 50 | 1098 (592) |
| 70 | 1168 (631) |
| 90 | 1303 (706) |
| 95 | 1343 (728) |
| Entire product | 1352 (733) |

The HVGO FCC feedstock 38 from the hydrocracker vacuum distillation column 36 is passed to a standard fluidized catalytic cracking (FCC) unit 39. FCC units convert high-boiling, high-molecular weight hydrocarbon fractions of petroleum crude oils into more valuable gasoline 40, olefinic fractions used for making alkylate, and other products such as naphtha.

The side-cut VGO fraction 37 is subjected to hydrocracking conditions in a second stage hydrocracking unit 41 to yield a second stage hydrocracked effluent 42 which, in turn, is passed to the hydrocracker vacuum distillation column 36 for distillation. The catalysts and operating conditions in the first stage and second stage hydroprocessing reaction zones respectively avoid the undesirable over-saturation of the vacuum bottoms stream, the latter essentially comprised of the unconverted heavy gas oil components. This leads to a significant reduction in overall hydrogen consumption.

Table 7 below lists the typical physical properties for second stage hydrocracking effluent 42, and Table 8 illustrates the second stage hydrocracking process conditions.

TABLE 7

| | $2^{nd}$ Stage Hydrocracking Effluent |
|---|---|
| Properties | |
| Gravity, °API | 35-40 |
| N, ppm | 10-50 |
| S, ppm | 50-200 |
| Distillation Temperature (wt %), ° F. (° C.) | |
| 5 | 750 (399) |
| 10 | 760 (404) |
| 30 | 780 (416) |
| 50 | 820 (438) |
| 70 | 880 (471) |

TABLE 7-continued

| | $2^{nd}$ Stage Hydrocracking Effluent |
|---|---|
| 90 | 930 (499) |
| 95 | 950 (510) |
| End Point | 1000 (538) |

TABLE 8

| $2^{nd}$ Stage Hydrocracking Conditions | |
|---|---|
| Liquid hour space velocity (LHSV) | 1.0-4.0 $hr^{-1}$ |
| $H_2$ partial pressure | 500-2000 psig |
| $H_2$ consumption rate | 500-1500 SCF/Bbl |
| Operating temperature | 670-750° F. (354-399° C.) |
| Conversion | 60-80% |

Referring again to FIG. 2, in one embodiment a vacuum tower bottoms effluent 43 from the vacuum distillation unit 24 is passed to a coker 44 for processing into a naptha feedstock 45 and a coker heavy gas oil 46. The coker heavy gas oil 46 is combined with the HVGO feedstock 25 for eventual hydroprocessing in the first stage hydrocracker unit 28. The unique configuration of the present invention allows for the concurrent hydroprocessing of a HVGO feedstock and coker heavy gas oil, as the configuration of the present invention is not operated as a full conversion system.

The refinery configuration illustrated in FIG. 2 has several advantages over conventional two-stage hydrocracking schemes. First, in the configuration of the present invention, the catalyst and operating conditions of the first stage hydrocracking unit 28 are selected to yield a HVGO FCC having only the minimum feed qualities necessary to produce FCC products which meet the established commercial specifications. This is in contrast to a conventional two-stage hydrocracking scheme where the first stage hydrocracking unit is operated at a severity necessary to maximize distillate yield which, in turn, requires the unit to be operated at more severe conditions (which requires more hydrogen and reduces the life of the catalyst).

Second, the side-cut VGO sent to the second stage hydrocracker unit is cleaner and easier to hydrocrack than a conventional second stage hydrocracker feed. Therefore, higher quality middle distillate products can be achieved using a smaller volume of second stage hydrocracking catalyst which, in turn, allows for the construction of a smaller hydrocracker reactor and consumption of less hydrogen. The second stage hydrocracking unit configuration reduces construction cost, lowers catalyst fill cost and operating cost.

In addition, unlike conventional two-stage hydrocracking schemes, which operate as "full conversion" systems (meaning all of the hydrotreating and hydrocracking is accomplished within the hydrocracking units), the refinery scheme of the present invention allows the undesirable feed components such as the polynuclear aromatics, nitrogen and sulfur species to pass out of the hydrocracking loop and to the FCC unit, which uses a catalyst which is more tolerant of such species (not prone to deactivation as a result of catalytic interaction with such species) and exhibits a higher conversion rate for such species as compared to hydrocracking catalysts.

Finally, because the first stage hydrocracking unit 28 is operated at lower severity selected to achieve the target HVGO FCC feed specifications rather than the clean second stage feed specifications, more disadvantaged feedstocks can be refined in the scheme of the present invention.

Hydrotreating Catalyst

Catalysts used in carrying out the hydrotreating process includes at least one hydrotreating catalyst support, one or more metals, and optionally one or more promoters.

For each embodiment described herein, the hydrotreating catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In one subembodiment, the hydrotreating catalyst support is an alumina selected from the group consisting of γ-alumina, η-alumina, θ-alumina, δ-alumina, χ-alumina, and mixtures thereof.

In another subembodiment, the hydrotreating catalyst support is an amorphous silica-alumina material in which the mean mesopore diameter is between 70 Å and 130 Å.

In another subembodiment, the hydrotreating catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$ and a total pore volume of between 0.75 and 1.05 mL/g.

In another subembodiment, the hydrotreating catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$, a total pore volume of between 0.75 and 1.05 mL/g, and a mean mesopore diameter is between 70 Å and 130 Å.

For each embodiment described herein, the amount of hydrotreating catalyst support in the hydroprocessing catalyst is from 5 wt. % to 80 wt. % based on the bulk dry weight of the hydroprocessing catalyst.

As described herein above, the hydrotreating catalyst may contain one or more metals selected from the group consisting of elements from Group 6 and Groups 8 through 10 of the Periodic Table, and mixtures thereof. In one subembodiment, each metal is selected from the group consisting of nickel (Ni), cobalt (Co), iron (Fe), chromium (Cr), molybdenum (Mo), tungsten (W), and mixtures thereof. In another subembodiment, the hydroprocessing catalyst contains at least one Group 6 metal and at least one metal selected from Groups 8 through 10 of the Periodic Table. Exemplary metal combinations include Ni/Mo/W, Ni/Mo, Ni/W, Co/Mo, Co/W, Co/W/Mo and Ni/Co/W/Mo.

The total amount of metal oxide material in the hydroprocessing catalyst is from 0.1 wt. % to 90 wt. % based on the bulk dry weight of the hydroprocessing catalyst. In one subembodiment, the hydroprocessing catalyst contains from 2 wt. % to 10 wt. % of nickel oxide and from 8 wt. % to 40 wt. % of tungsten oxide based on the bulk dry weight of the hydroprocessing catalyst.

A diluent may be employed in the formation of the hydroprocessing catalyst. Suitable diluents include inorganic oxides such as aluminum oxide and silicon oxide, titanium oxide, clays, ceria, and zirconia, and mixture of thereof. The amount of diluent in the hydroprocessing catalyst is from 0 wt. % to 35 wt. % based on the bulk dry weight of the hydroprocessing catalyst. In one subembodiment, the amount of diluent in the hydroprocessing catalyst is from 0.1 wt. % to 25 wt. % based on the bulk dry weight of the hydroprocessing catalyst.

The hydroprocessing catalyst of the present invention may contain one or more promoters selected from the group consisting of phosphorous (P), boron (B), fluorine (F), silicon (Si), aluminum (Al), zinc (Zn), manganese (Mn), and mixtures thereof. The amount of promoter in the hydroprocessing catalyst is from 0 wt. % to 10 wt. % based on the bulk dry weight of the hydroprocessing catalyst. In one subembodiment, the amount of promoter in the hydroprocessing catalyst is from 0.1 wt. % to 5 wt. % based on the bulk dry weight of the hydroprocessing catalyst.

In one embodiment, the hydrotreating catalyst is a bulk metal or multi-metallic catalyst wherein the amount of metal is 30 wt. % or greater, based on the bulk dry weight of the hydrotreating catalyst.

Hydrocracking Catalysts

Catalysts used in carrying out the hydrocracking process includes at least one hydrocracking catalyst support, one or more metals, optionally one or more molecular sieves, and optionally one or more promoters.

For each embodiment described herein, the hydrocracking catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In one subembodiment, the hydrocracking catalyst support is an alumina selected from the group consisting of γ-alumina, η-alumina, θ-alumina, δ-alumina, χ-alumina, and mixtures thereof.

In another subembodiment, the hydrocracking catalyst support is an amorphous silica-alumina material in which the mean mesopore diameter is between 70 Å and 130 Å.

In another subembodiment, the hydrocracking catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$ and a total pore volume of between 0.75 and 1.05 mL/g.

In another subembodiment, the hydrocracking catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$, a total pore volume of between 0.75 and 1.05 mL/g, and a mean mesopore diameter is between 70 Å and 130 Å

For each embodiment described herein, the amount of hydrocracking catalyst support in the hydroprocessing catalyst is from 5 wt. % to 80 wt. % based on the bulk dry weight of the hydroprocessing catalyst.

For each embodiment described herein, the hydroprocessing catalyst may optionally contain one or more molecular sieves selected from the group consisting of BEA-, ISV-, BEC-, IWR-, MTW-, *STO-, OFF-, MAZ-, MOR-, MOZ-, AFI-, *NRE, SSY-, FAU-, EMT-, ITQ-21-, ERT-, ITQ-33-, and ITQ-37-type molecular sieves, and mixtures thereof.

In one subembodiment, the one or more molecular sieves selected from the group consisting of molecular sieves having a FAU framework topology, molecular sieves having a BEA framework topology, and mixtures thereof.

The amount of molecular sieve material in the hydroprocessing catalyst is from 0 wt. % to 60 wt. % based on the bulk dry weight of the hydroprocessing catalyst. In one subembodiment, the amount of molecular sieve material in the hydroprocessing catalyst is from 0.5 wt. % to 40% wt. %.

The catalyst may optionally contain a non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (J. Am. Chem. Soc., 114:10834 10843(1992)), MCM-41 (U.S. Pat. Nos. 5,246,689; 5,198,203; 5,334,368), and MCM-48 (Kresge et al., Nature 359: 710 (1992)).

In one subembodiment, the molecular sieve is a Y zeolite with a unit cell size of 24.15 Å-24.45 Å. In another subembodiment, the molecular sieve is a Y zeolite with a unit cell size of 24.15 Å-24.35 Å. In another subembodiment, the molecular sieve is a low-acidity, highly dealuminated ultrastable Y zeolite having an Alpha value of less than 5 and a Brønsted acidity of from 1 to 40. In one subembodiment, the molecular sieve is a Y zeolite having the properties described in Table 9 below.

TABLE 9

| | |
|---|---|
| Alpha value | 0.01-5 |
| CI | 0.05-5% |
| Brønsted acidity | 1-40 μmole/g |
| SAR | 80-150 |
| surface area | 650-750 $m^2/g$ |
| micropore volume | 0.25-0.30 mL/g |
| total pore volume | 0.51-0.55 mL/g |
| unit cell size | 24.15-24.35 Å |

In another subembodiment, the molecular sieve is a Y zeolite having the properties described in Table 10 below.

TABLE 10

| | |
|---|---|
| SAR | 10-∞ |
| micropore volume | 0.15-0.27 mL/g |
| BET surface area | 700-825 $m^2/g$ |
| unit cell size | 24.15-24.45 Å |

In another subembodiment, the catalyst contains from 0.1 wt. % to 40 wt. % (based on the bulk dry weight of the catalyst) of a Y zeolite having the properties described Table 4 above, and from 1 wt. % to 60 wt. % (based on the bulk dry weight of the catalyst) of a low-acidity, highly dealuminated ultrastable Y zeolite having an Alpha value of less than about 5 and Brønsted acidity of from 1 to 40 micromole/g.

As described herein above, the hydroprocessing catalyst of the present invention contains one or more metals. For each embodiment described herein, each metal employed is selected from the group consisting of elements from Group 6 and Groups 8 through 10 of the Periodic Table, and mixtures thereof. In one subembodiment, each metal is selected from the group consisting of nickel (Ni), cobalt (Co), iron (Fe), chromium (Cr), molybdenum (Mo), tungsten (W), and mixtures thereof. In another subembodiment, the hydroprocessing catalyst contains at least one Group 6 metal and at least one metal selected from Groups 8 through 10 of the Periodic Table. Exemplary metal combinations include Ni/Mo/W, Ni/Mo, Ni/W, Co/Mo, Co/W, Co/W/Mo and Ni/Co/W/Mo.

The total amount of metal oxide material in the hydroprocessing catalyst is from 0.1 wt. % to 90 wt. % based on the bulk dry weight of the hydroprocessing catalyst. In one subembodiment, the hydroprocessing catalyst contains from 2 wt. % to 10 wt. % of nickel oxide and from 8 wt. % to 40 wt. % of tungsten oxide based on the bulk dry weight of the hydroprocessing catalyst.

A diluent may be employed in the formation of the hydroprocessing catalyst. Suitable diluents include inorganic oxides such as aluminum oxide and silicon oxide, titanium oxide, clays, ceria, and zirconia, and mixture of thereof. The amount of diluent in the hydroprocessing catalyst is from 0 wt. % to 35 wt. % based on the bulk dry weight of the hydroprocessing catalyst. In one subembodiment, the amount of diluent in the hydroprocessing catalyst is from 0.1 wt. % to 25 wt. % based on the bulk dry weight of the hydroprocessing catalyst.

The hydroprocessing catalyst of the present invention may contain one or more promoters selected from the group consisting of phosphorous (P), boron (B), fluorine (F), silicon (Si), aluminum (Al), zinc (Zn), manganese (Mn), and mixtures thereof. The amount of promoter in the hydroprocessing catalyst is from 0 wt. % to 10 wt. % based on the bulk dry weight of the hydroprocessing catalyst. In one subembodiment, the amount of promoter in the hydroprocessing catalyst is from 0.1 wt. % to 5 wt. % based on the bulk dry weight of the hydroprocessing catalyst.

The conditions for the first hydrocracking stage are as follows: the overall liquid hourly space velocity (LHSV) is about 0.25 to 4.0 $hr^{-1}$, preferably about 1.0 to 3.0 $hr^{-1}$. The hydrogen partial pressure is greater than 200 psig, preferably ranging from about 500 to about 2000 psig. Hydrogen re-circulation rates are typically greater than 50 SCF/Bbl, and are preferably between 1,000 and 1,000 SCF/Bbl. Temperatures range from about 300 to about 750° F., preferably ranging from 450 to 650° F.

Products

The process of this invention is especially useful in the production of middle distillate fractions boiling in the range of about 250-700° F. (121-371° C.). At least 75 vol %, preferably at least 85 vol % of the components of the middle distillate have a normal boiling point of greater than 250° F. (121° C.). At least about 75 vol %, preferably 85 vol % of the components of the middle distillate have a normal boiling point of less than 700° F. (371° C.).

Gasoline or naphtha may also be produced in the process of this invention. Gasoline or naphtha normally boils in the range below 400° F. (204° C.) but boiling above the boiling point of $C_5$ hydrocarbons, and sometimes referred to as a $C_5$ to 400° F. (204° C.) boiling range. Boiling ranges of various product fractions recovered in any particular refinery will vary with such factors as the characteristics of the crude oil source, local refinery markets and product prices.

While the invention has been described in detail and with reference to specific embodiments thereof, it will be apparent to one skilled in the art that various changes and modifications can be made without departing from the spirit and scope of the invention.

What is claimed is:

1. A process for making at least one middle distillate and a heavy vacuum gas fluidized catalytic cracking feedstock, comprising:

hydrocracking a hydrocarbonaceous feedstock at a 20 to 30% conversion rate to produce a first stage hydrocracked effluent;

distilling the hydrocracked feedstock by atmospheric distillation in an atmospheric distillation unit to form at least one middle distillate fraction and an atmospheric bottoms fraction;

further distilling the atmospheric bottoms fraction by vacuum distillation in a vacuum distillation unit to form a side-cut vacuum gas oil fraction and a heavy vacuum gas oil fluidized catalytic cracking (FCC) feedstock;

passing the side-cut vacuum gas oil fraction directly to a second stage hydrocracker and hydrocracking the side-cut vacuum gas oil fraction to form a second stage hydrocracked effluent;

passing the heavy vacuum gas oil FCC feedstock directly to an FCC unit; and combining the second stage hydrocracked effluent with the first stage hydrocracked effluent.

2. The process of claim 1, wherein the hydrocarbonaceous feedstock is hydrotreated to produce a hydrotreated hydrocarbonaceous feedstock, followed by hydrocracking the hydrotreated hydrocarbonaceous feedstock to produce the first stage hydrocracked effluent.

3. The process of claim 2, wherein the hydrotreating of the hydrocarbonaceous feedstock is conducted at a 25 to 30% conversion rate.

4. The process of claim 1, wherein the hydrocarbonaceous feedstock comprises an API gravity of 13.5 to 17, a nitrogen content of 4,000 to 7,000 ppm, a sulfur content of 2.5 to 4.5 weight percent, and a polycyclic index of 7,000 to 11,000.

5. The process of claim 1, wherein the side-cut vacuum distillation fraction has a cut-point of 900° F. (482° C.) to 1,000° F. (538° C.).

6. The process of claim 5, wherein the side-cut vacuum distillation fraction has a API gravity of 30 to 34, a nitrogen content of 1 to 3 ppm, and a sulfur content of 10 to 100 ppm.

7. The process of claim 6, wherein the heavy vacuum gas oil feedstock has an API gravity of 25 to 29, a nitrogen content of 10 to 150 ppm, and a sulfur content of 100 to 1,000 ppm.

8. The process of claim 1, wherein the heavy vacuum gas oil feedstock has an API gravity of 25 to 29, a nitrogen content of 10 to 150 ppm, and a sulfur content of 100 to 1,000 ppm.

9. The process of claim 1, wherein the step of hydrocracking the side-cut vacuum gas oil fraction is conducted at a 60 to 80% conversion rate.

10. The process of claim 1, wherein the step of hydrocracking the side-cut vacuum gas oil fraction is conducted at a 60 to 80% conversion rate.

11. The process of claim 1, wherein the heavy vacuum gas oil FCC feedstock to the FCC unit is a 900° F. (482° C.) or greater feedstream.

12. The process of claim 1, wherein the combined second stage hydrocracked effluent and first stage hydrocracked effluent is passed directly to the atmospheric distillation unit.

13. The process of claim 1, wherein the atmospheric bottoms fraction is passed directly to the vacuum distillation unit.

* * * * *